United States Patent [19]

Mitchell

[11] 4,339,127

[45] Jul. 13, 1982

[54] AXLE-MOUNTED WHEEL EXERCISING DEVICE

[76] Inventor: Elston Mitchell, 164 N. Summit, Decatur, Ill. 62522

[21] Appl. No.: 198,390

[22] Filed: Oct. 20, 1980

[51] Int. Cl.[3] ..... A63B 21/00

[52] U.S. Cl. ..... 272/127

[58] Field of Search ..... 272/127, 143, 131, 126, 272/96

[56] References Cited

U.S. PATENT DOCUMENTS

| | | | |
|---|---|---|---|
| 1,824,920 | 9/1931 | Novak | 272/127 |
| 2,416,471 | 2/1947 | Chappedelaine | 272/117 X |
| 3,752,475 | 8/1973 | Ott | 272/127 |

*Primary Examiner*—Richard C. Pinkham
*Assistant Examiner*—William R. Browne
*Attorney, Agent, or Firm*—Howard L. Rose

[57] ABSTRACT

A wheeled hand-held exercise device for strengthening the muscles of one's midsection is provided. The device has at least two wheels mounted on an axle and has shafts connected to and extending both coaxial with and perpendicular to said axle.

4 Claims, 5 Drawing Figures

AXLE-MOUNTED WHEEL EXERCISING DEVICE

This invention relates to exercise devices for strengthening the muscles of one's midsection. In particular, this invention relates to wheeled hand-held exercise devices designed to strengthen the muscles of a person's midsection by having the person kneel and push the exercise device towards and away from the user and also by swinging the exercise device in an arc around one's self to further strengthen the muscles of such region.

BACKGROUND OF THE INVENTION

Hand-held exercise devices having at least one wheel on a single axis with hand grips and utilized to strengthen one's midsection by rolling the device along the floor are well known in the art. For example, see U.S. Pat. No. 4,136,867, entitled "Vibrating Exercising Wheel" and issued to Wilkin on Jan. 30, 1979; U.S. Pat. No. 3,403,906, entitled "Exerciser with Grippers on a Roller Mounting Shaft" issued to R. Burzenski on Oct. 1, 1968; and U.S. Pat. No. 2,821,394, entitled "Spring Roller-Type Exerciser" and issued to R. J. M. Barbeau on Jan. 28, 1958. Also known is the "Waist Wheel" produced by Anthony Enterprises of San Francisco, Calif. One method of using these devices is for one to kneel on one's knees and to repeatedly run these devices towards and away from one's self along the floor, keeping one's knees stationary (see FIG. 1 of the Wilkins patent). Exercising repeatedly in this manner will greatly improve and strengthen one's stomach muscles.

However, the above prior art devices are limited in their usage to pushing and pulling in limited directions with respect to one's self. While employing the device in this manner is good for the stomach muscles, it does not exercise or strengthen the muscles used in twisting and turning at the midsection and located on the side of one's midsection.

Hand-held wheeled exercise devices of the type described above that have castors that run along the floor are also well known. For example, see U.S. Pat. Nos. 4,134,584, issued to Rosenbusch on Jan, 16, 1979; 3,809,393, issued to Jones on May 7, 1974; and 3,796,431, issued to Sinyard on Mar. 12, 1974.

While these prior art devices are not limited to employment in a limited number of directions as the previously described devices, these devices lack the control of a simple wheeled device because of the ability of the castors to go in any direction. Thus, it is an object of this invention to provide a wheeled hand-held exercise device for strengthening one's midsection which can be used in lateral directions as well as in a direction directly in front of the body.

It is a further object of this invention to provide a wheeled hand-held exercise device for strengthening the muscles along the sides of one's midsection.

IN THE DRAWINGS

DETAILED DESCRIPTION OF THE DRAWINGS

Figure 1:
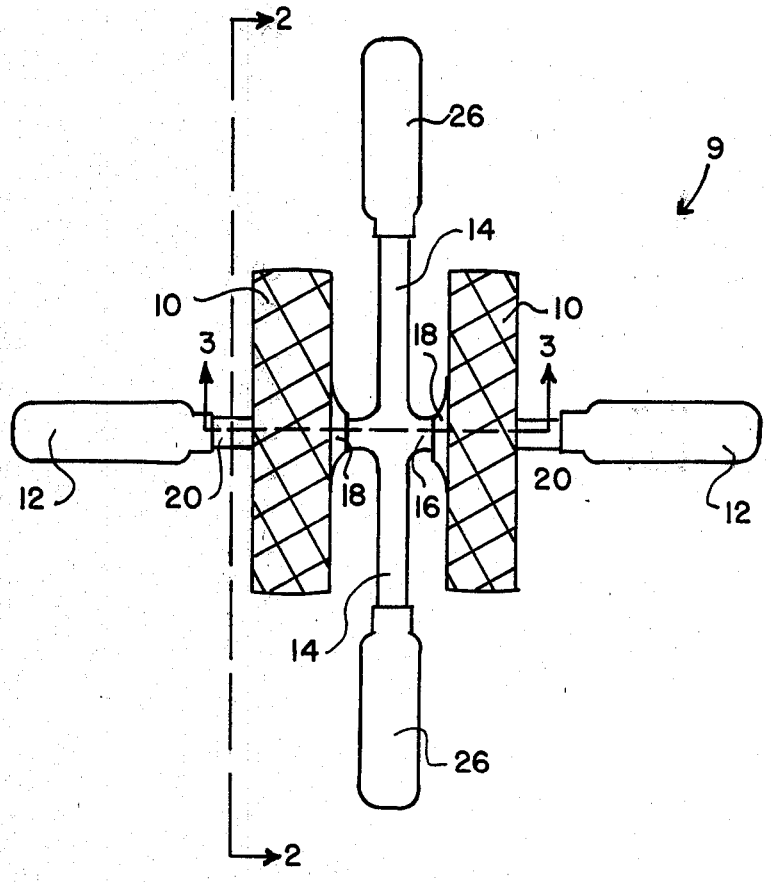
FIG. 1 is a plan view of one embodiment of this invention.
Figure 2:
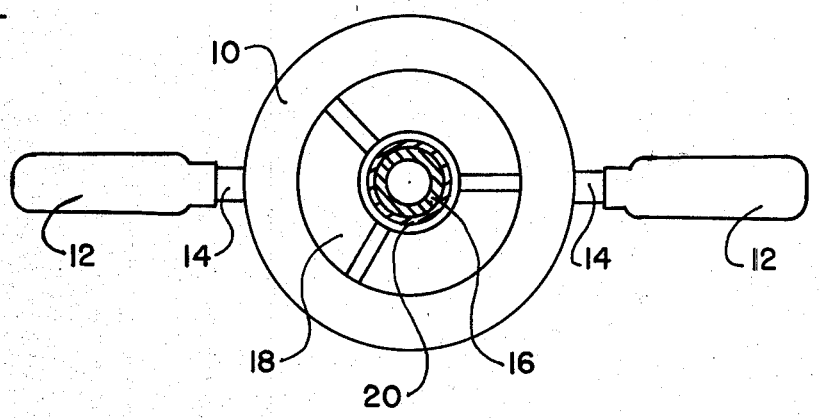
FIG. 2 is a partially sectionalized side view, taken along line 2—2 of FIG. 1, of the embodiment of this invention illustrated in FIG. 1.
Figure 3:
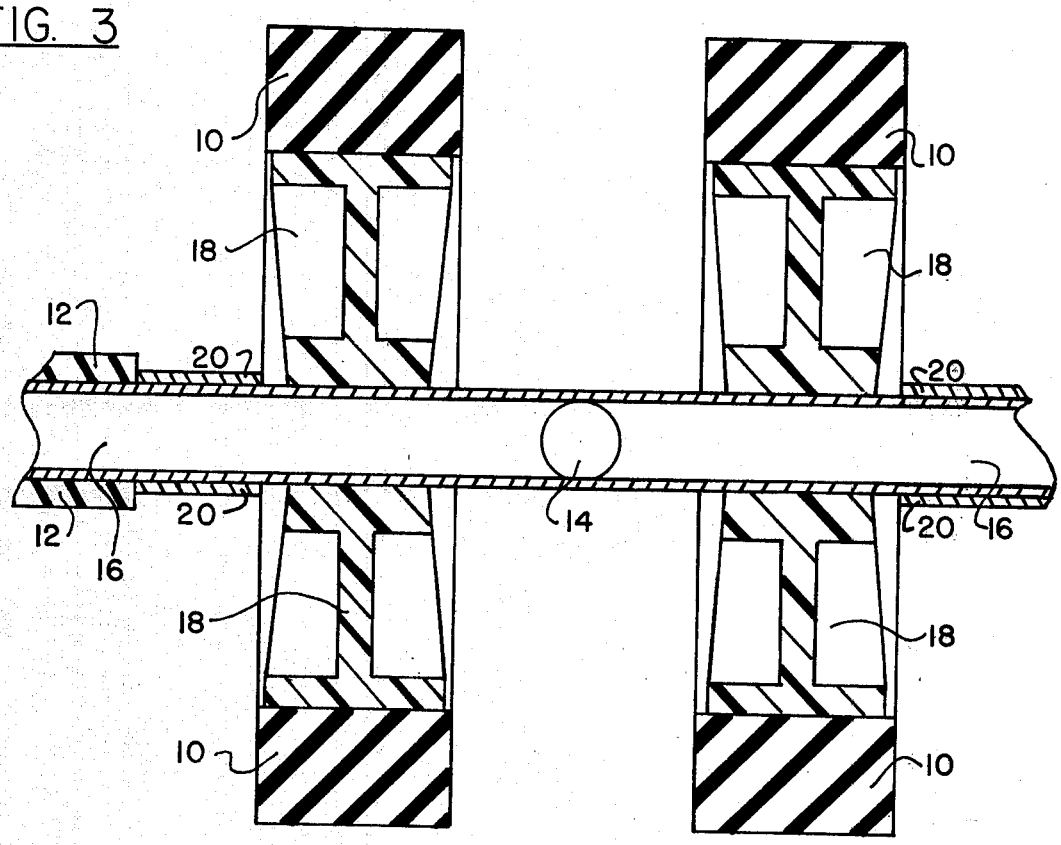
FIG. 3 is a cross sectional view, taken along line 3—3 of FIG. 1, of the embodiment of this invention illustrated in FIG. 1.

Referring to FIGS. 1–3, exercise device 9 is comprised of two wheels 10 which are mounted on rims 18 in turn mounted on axle 16. Rims 18 are held in place on axle 16 by washers 20 which are also mounted on axle 16. Rims 18 are sandwiched between washers 20 and shafts 14. Washers 20 are located on axle 16 between rims 18 and handgrips 12, handgrips 12 firmly gripping axle 16.

Handgrips 12 are located on the ends of axle 16 to provide a means for the user to grip exercise device 9. Handgrips 12 may be comprised of rubber in this embodiment and may be similar to the handgrips found on many bicycle handlebars.

Connected to the center of axle 16 at right angles to and extending in the same horizontal plane as axle 16, are shafts 14. Shafts 14 extend from between the wheels 10 in front and in back of the wheels as shown in FIG. 1.

Handgrips 26 are located on the ends of shafts 14, the same as handgrips 12 are located to the ends of axle 16.

The embodiment of exercise device 9, illustrated in the Figures, is constructed and arranged to be primarily used in accordance with the following two methods:

One method of employing this device is to grasp exercise device 9 with one hand on each of handgrips 12 respectively, and while sitting on one's knees, run exercise device 9 towards and away from one's self on the floor. This will primarily serve to exercise and strengthen one's stomach muscles and back muscles.

Figure 4:
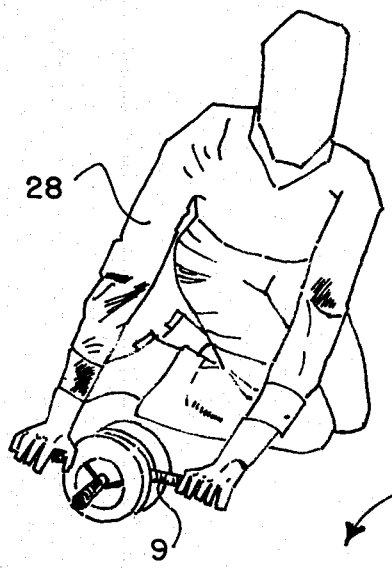
FIG. 4 is a perspective view illustrating a person employing one embodiment of this invention in a lateral motion.
Figure 5:
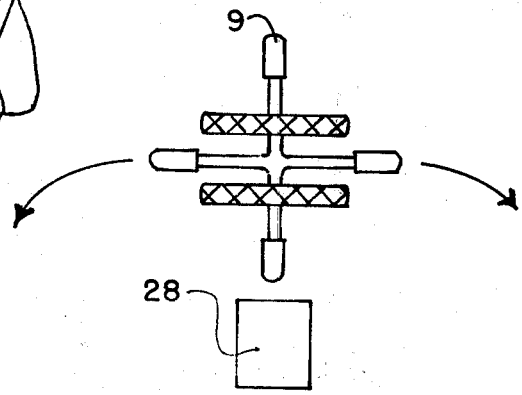
FIG. 5 is a plan view illustrating how this invention can be employed to strengthen the side muscles of one's midsection.

The second method of employing exercise device 9 is to grasp handgrips 26, one in each hand respectively, and employ exercise device 9 as shown in FIGS. 4 and 5. Exercise device 9 is placed at the side of person 28 as shown in FIG. 4, instead of directly in front as per the previous method, and swings in an arc around person 28 in accordance with FIG. 5. This method will exercise and strengthen one's side muscles since one's midsection is twisting and stretching as exercise device 9 is used in this manner. In particular, employing the device in this manner serves to tone the external oblique muscles which flex and rotate the human trunk and the quadratus muscles which are employed to bend the human trunk laterally.

The prior art wheeled devices cannot be employed in a manner similar to this latter manner. In the first instance, none of the devices provide the handle 14 necessary to the arcuate or twisting motion described herein. The single wheeled devices cannot be utilized in such mode due to the unavoidable offset from the plane of a single wheel of the handle 14 and the resulting instability. Similarly, although the castor-supported prior art devices can roll along the path of the second method, they do not permit the control this invention offers since the castor devices can go in any direction and will uncontrollably roll to the side when attempting to apply the second method. Further, the castor devices are limited with respect to the surfaces on which they can be employed, since the devices may snag on shag or deep pile carpeting or in grassy areas. The subject invention can be used on any floor surface or even grassy areas by individuals who prefer to exercise outdoors.

When exercise device 9 is repeatedly used in both manners discussed above by a person, the entire waist of that person will become more firm.

In addition, the device can be employed by standing up, with feet closely together, bending over at the waist, gripping either handgrips 12 or handgrips 26, and moving exercise device 9 in either of the motions discussed above. Employing exercise device 9 in this manner will strengthen both the stomach and leg muscles.

Furthermore, bearings could be employed, if desired, between the rims and the axle to reduce friction, thus making the device easier to roll.

Once given the above disclosure, other features, modifications, and improvements will become apparent to one skilled in the art. These features, modifications, and improvements are, therefore, considered to be within the scope of this invention as defined by the following claims:

I claim:

1. An exercise device to be employed by pushing and pulling along a surface including:

a pair of wheels, an axle having said pair of wheels rotatably mounted coaxially thereon, said wheels of said pair of wheels being spaced apart along said axle, a shaft connected to said axle between said wheels, said axle and said shaft being alternately engaeable by the limbs of a user for pushing and pulling operation to roll said wheels over a surface, and said shaft being perpendicular to said axle and extending in two directions from said axle.

2. An exercise device according to claim 1 wherein said shaft is in the same horizontal plane as said axle and is divided into two segments, one of said segments extending in one direction from said axle, and the other of said segments extending in the opposite direction from said axle.

3. An exercise device according to claim 1 further comprising two handgrips located on each end of said shaft respectively.

4. The device according to claim 1 comprising a pair of shafts each extending from opposite ends of and coaxial with said axle, outward of said wheels.

* * * * *